United States Patent [19]

Ahlgren

[11] 4,128,610

[45] Dec. 5, 1978

[54] METHOD FOR CASTING CONCRETE STRUCTURES

[76] Inventor: Nils H. Ahlgren, 22 Skyttevägen, S-133 00 Saltsjobaden, Sweden

[21] Appl. No.: 768,691

[22] Filed: Feb. 14, 1977

[30] Foreign Application Priority Data

Feb. 20, 1976 [SE] Sweden ..... 7602035

[51] Int. Cl.[2] ..... E04B 1/16

[52] U.S. Cl. ..... 264/33; 249/20; 264/34; 425/63

[58] Field of Search ..... 264/33, 34; 425/63-65; 249/20-22

[56] References Cited

U.S. PATENT DOCUMENTS

| | | | |
|---|---|---|---|
| 3,778,491 | 12/1973 | Andreer | 264/33 X |
| 3,901,472 | 8/1975 | Ahlgren | 425/63 X |
| 4,063,857 | 12/1977 | Thoma | 425/63 |

*Primary Examiner*—Thomas P. Pavelko
*Attorney, Agent, or Firm*—Rose & Edell

[57] ABSTRACT

The invention relates to a method for casting of concrete structures by means of moulds disposed at two opposite sides of the structure to be cast. The moulds are pressed against the concrete structure by the legs of a yoke construction which is arranged to be successively lifted by jacks cooperating with jack rods. The legs of the yoke construction are caused during lifting to slide directly or indirectly against the jack rods which are positioned between the legs of the yoke construction and the moulds.

7 Claims, 7 Drawing Figures

8
8

6
10
9
14
9
3
1
2
11
13
12
12
5
13
13
4
15
12
11
11
15
7
7

METHOD FOR CASTING CONCRETE STRUCTURES

The present invention relates to a method for the casting of concrete structures by means of moulds disposed at two opposite sides of the structure to be cast, the moulds being pressed against the concrete structure by the legs of a yoke construction which is arranged to be successively lifted by jacks cooperating with jack rods.

According to the invention, the legs of the yoke construction are caused during lifting to slide against the jack rods or against appropriate slide surfaces associated therewith that are positioned between the legs of the yoke construction and the moulds. The frictional forces deriving from the displacement will hereby be transmitted directly to the jack rods. This entails considerable advantages in the use of sliding as well as of non-sliding moulds.

The invention will be described in greater detail hereinbelow with reference to the accompanying drawings illustrating various embodiments for carrying out the method of the invention.

In the drawings:

FIG. 1 illustrates in transverse cross-section the casting of a vertical concrete wall;

FIG. 2 on a larger scale illustrates in horizontal cross-section one leg of the yoke construction of FIG. 1 with an adjoining mould;

FIG. 3 shows that the casting of a vertical concrete wall by the method of the invention may be temporarily interrupted to allow casting of a floor slab structure or the like;

Figure 1:
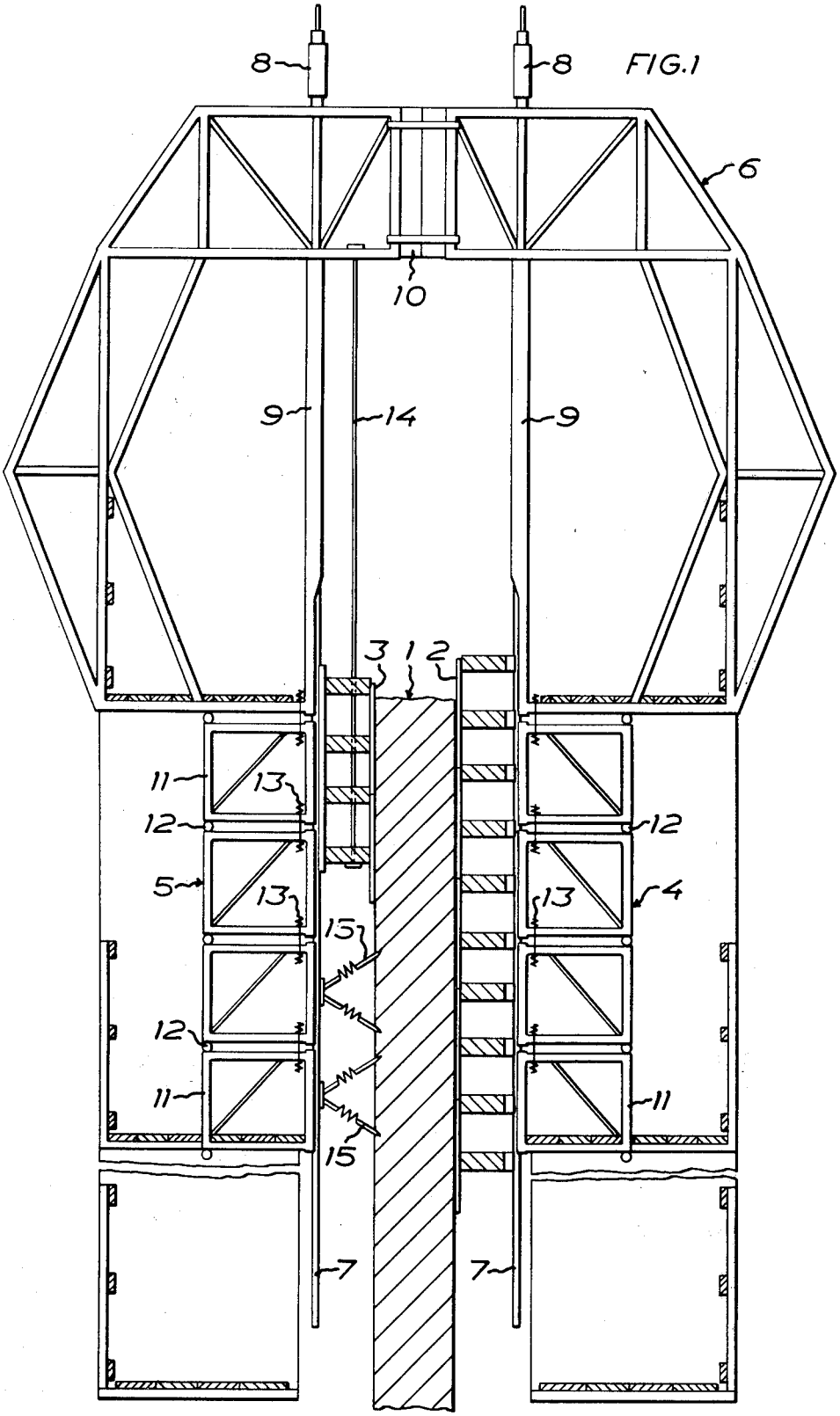

In the drawings, 1 designates the vertical concrete wall which is being cast between the moulds 2 and 3 disposed at two opposite sides of the concrete wall 1. The moulds 2 and 3 are pressed against the concrete wall 1 by the legs 4 and 5 of the yoke construction 6 which is arranged to be lifted successively by means of jacks 8 cooperating with jack rods 7.

According to the invention, the legs 4 and 5 of the yoke construction 6 are caused during the lifting operation to slide against the jack rods 7 which are positioned between the legs 4 and 5 of the yoke construction 6 and the moulds 2 and 3. The legs 4 and 5 need not necessarily slide directly against the jack rods 7 but may instead slide against slide surfaces associated with the jack rods 7.

The distance between the jack rods 7 at either side of the concrete wall 1 is determined by the thickness of the concrete wall 1. It must therefore be possible to adapt the width of the yoke construction 6 with regard to said distance such that the jacks 8 with associated tubular guides 9 for the jack rods 7 are given the correct position. To this end, the yoke construction 6 comprises interchangeable spacers 10.

In order to ensure a correct function of the installation, it is essential that the lower portions of the legs 4 and 5 of the yoke construction 6 are caused to produce a pressure against those parts of the concrete structure, i.e. of the concrete wall 1, which have hardened. It is in fact the concrete structure 1 that is to support the yoke construction 6 by the produced frictional force.

The legs 4 and 5 of the yoke construction 6 may in and per se be designed in such a manner that their lower portions bring about the desired pressure against the concrete structure 1. In the shown embodiment, the pressure exerted by the lower leg portions against the concrete structure 1 is obtained by adjusting the resiliency of the legs 4 and 5. Thus, the legs 4 and 5 consist of a number of sections 11 which are mutually articulated at 12. The sections 11 are interconnected at 13 by preferably adjustable resilient means which by their spring action urge the sections 11 towards the concrete structure 1. The resilient means 13 may comprise an optional number of spring washers inserted under tension.

In the embodiment of FIG. 1, the moulds 2 to the right of the concrete wall 1 are stationary. These moulds 2 which are pressed against the concrete wall 1 by the legs 4 of the yoke construction 6 are thus maintained in a non-displaceable fashion against the concrete wall 1 as the yoke construction 6 is being lifted by means of the jacks 8 cooperating with the jack rods 7 along which the legs 4 slide.

In the embodiment of FIG. 1, the moulds 3 to the left of the concrete wall 1 are movable. These moulds 3 which are pressed against the concrete wall 1 by the legs 5 of the yoke construction 6 are thus lifted together with the yoke construction 6. For this purpose, the moulds 3 are connected with the yoke construction 6 by means of wire ropes 14 or the like. Here, the frictional force is not transmitted from the jack rods 7 to the concrete wall 1 by the moulds 3 but by special means 15.

Figure 2:
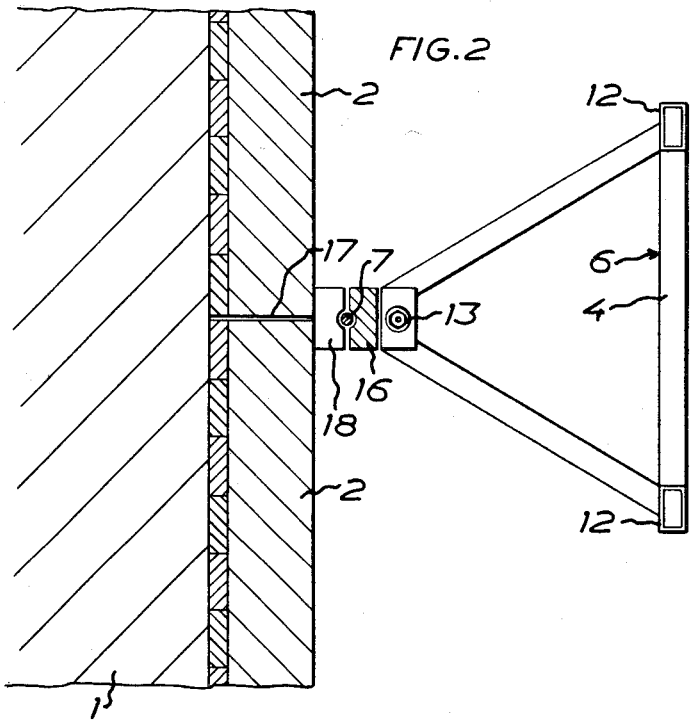

As is apparent from FIG. 2, the legs 4 (and 5) of the yoke construction 6 may comprise elements of triangular section. At the apex of the triangle there is provided a slideway 16 for engagement with the jack rod 7. The preferably adjustable resilient means 13 is also disposed at the apex of the triangle, while the articulation 12 is positioned at the base thereof. The leg 4 exerts a pressure towards the joint 17 of two adjacent moulds 2 with which the jack rod 7 cooperates by the intermediary of spacers 18 opposing the joint 17.

Figure 3:
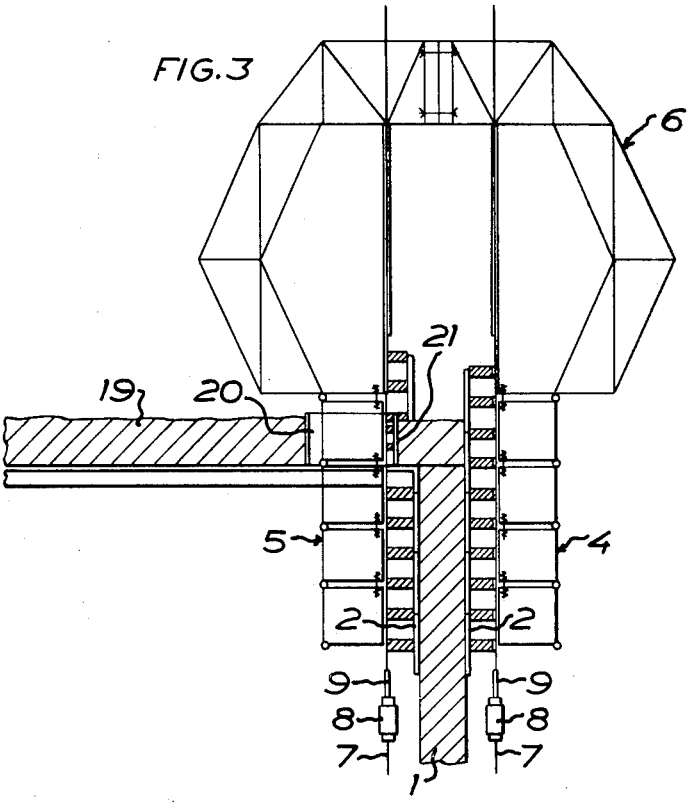

In the embodiment of FIG. 3, the casting of the concrete wall 1 is accomplished by means of moulds 2 which are maintained in a non-displaceable fashion against the concrete wall 1 by the pressure deriving from the legs 4 and 5 of the yoke construction 6. In this embodiment it is possible to interrupt the casting of the concrete wall 1, which in turn permits casting of a floor slab structure 19 or the like. The floor slab structure 19 is formed with a passage 20 for the leg 5 of the yoke construction 6, which passage 20 has a special mould 21 for cooperation with the leg 5 during the continued lifting of the yoke construction 6, once the casting of the floor slab structure 19 is completed.

It further appears from FIG. 3 that the jacks 8 need not necessarily be connected to the upper part of the yoke construction 6, as shown in FIG. 1, but the jacks 8 may instead be arranged to lift the yoke construction 6 from underneath by cooperating with the portions of jack rods 7 which are positioned below the yoke construction 6. In this embodiment, the jack rods 7 are similarly provided with guides 9 to prevent buckling.

The yoke construction 6 may be guided during the lifting operation in that the jacks 8 provide a non-uniform lift along the jack rods 7 at the two opposite sides of the structure 1. It is here possible to effect the guiding operation by increasing the lift force of the jacks 8 disposed on one side or by increasing the stroke of the jacks 8 on one side. It is further possible to effect guiding by modifying the engagement of the yoke construction 6 with respect to hardened concrete.

Figure 4:
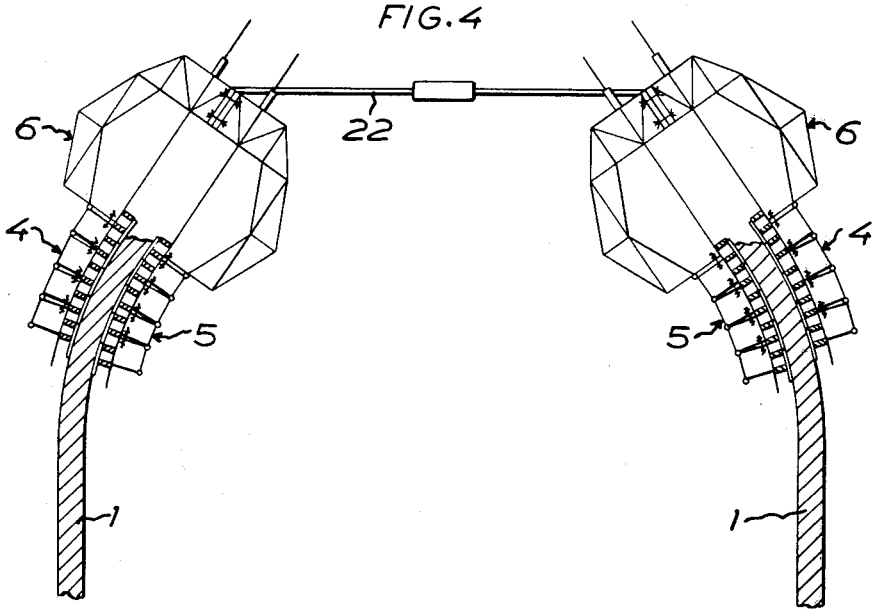
FIGS. 4 and 5 are examples of how the yoke construction may be guided during the casting operation.
Figure 5:
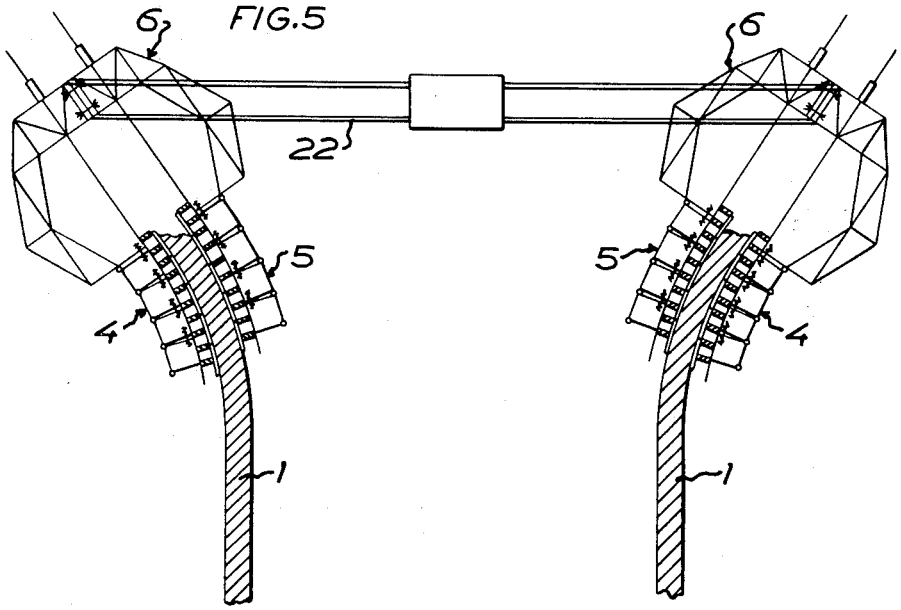

As shown in FIGS. 4 and 5, the yoke construction 6 may be guided during lifting by an appropriate force affecting the yoke construction 6. To this end, there is provided a special guiding device 22 between the uppermost parts of the yoke constructions 6. In a further embodiment, the yoke construction 6 is guided during the lifting operation in that the legs 4 and 5 of the yoke construction 6 are adjusted according to the desired shape of the concrete structure 1. Combinations of the above measures are also possible, as is apparent from FIGS. 4 and 5.

As shown in FIG. 5, it is convenient to use the method of the invention in the casting of vase-shaped water towers. It will be readily understood that the casting may be changed from vertical casting to horizontal casting. In such a case, the yoke construction 6 is supported either by the hardened concrete and/or by supporting means engaging the top end portion of the yoke construction 6. In some instances, the jacks 8 should be replaced, at least on one side of the concrete structure 1, by combined lifting and lowering jack means.

Figure 6:
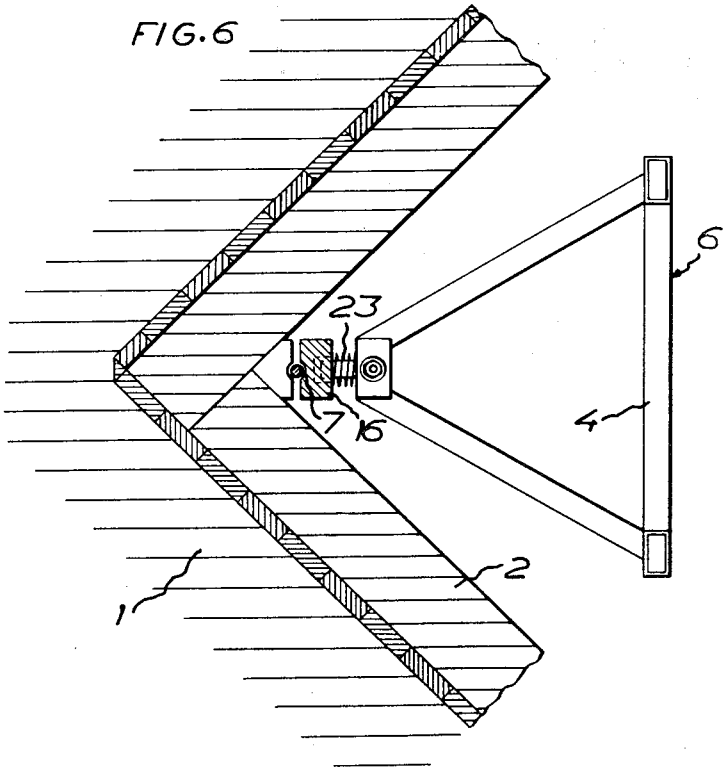

As shown in FIG. 6, the pressure of the leg portions against the concrete structure 1 is produced by resilient means 23 which are inserted under tension between the legs 4 (and 5) and the slideway 16 which during displacement of the yoke construction 6 slides against the jack rod 7. According to FIG. 7, the pressure of the leg portions against the concrete structure 1 is obtained by resilient means 24 which are inserted under tension between the mould element 2 and its associated member 25 cooperating with the jack rod 7.

Figure 7:
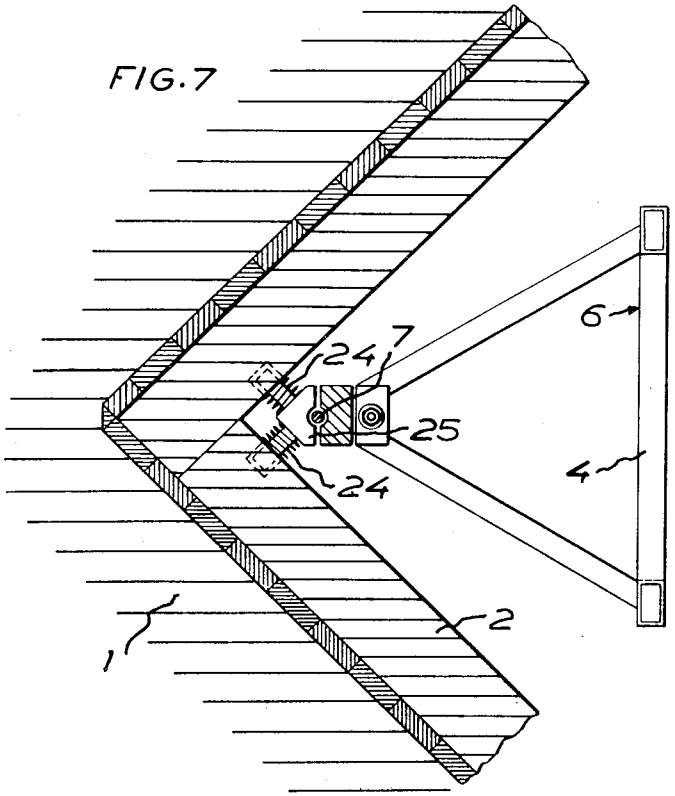
FIGS. 6 and 7 are two different embodiments illustrating one yoke leg cooperating with an adjoining mould portion.

From FIGS. 6 and 7 it will be appreciated that in some situations the provision of legs 4 and 5 of triangular section entails obvious advantages. The legs 4 and 5 will thereby be able to engage with angular portions. All the yoke constructions 6 need not necessarily have legs 4 and 5 of the same shape. Thus, some legs may be of rectangular, preferably square section.

The invention is not restricted to that described above and shown in the drawings but may be modified in various ways within the spirit and scope of the accompanying claims.

What I claim and desire to secure by Letters Patent is:

1. A method for the casting of concrete structures by means of moulds disposed at two opposite sides of the structure to be cast, said moulds being pressed against the concrete structure by the legs of a yoke construction which is arranged to be successively lifted by jacks cooperating with jack rods, said jack rods being fixed in place with respect to the concrete structure being cast during any lifting operation of said yoke construction; wherein the legs of said yoke construction are caused to produce a pressure, at least at their lower ends, against both sides of the concrete structure being cast, the pressure of each leg of said yoke being directed toward the other of said legs, said legs being caused during lifting to slide with respect to said jack rods; and wherein the weight of the yoke construction is carried by friction forces set up between the stationary jack rods and the concrete structure on both sides thereof.

2. Method as claimed in claim 1, wherein the pressure-exerted by the lower leg portions on the concrete structure is obtained by adjusting the resiliency of the legs.

3. Method as claimed in claim 1, wherein the moulds which are pressed against the concrete structure by the legs of the yoke construction, are lifted by means of the yoke construction.

4. Method as claimed in claim 1, wherein the moulds which are pressed against the concrete structure by the legs of the yoke construction are maintained against the concrete structure in a non-displaceable fashion during lifting of the yoke construction.

5. Method as claimed in claim 1, wherein the yoke construction is guided during lifting in that the jacks provide a non-uniform lifting along the jack rods at said two opposite sides of the concrete structure.

6. Method as claimed in claim 1, wherein the yoke construction is guided during lifting by an appropriate force affecting the yoke construction.

7. Method as claimed in claim 1, wherein the yoke construction is guided during lifting in that the legs of the yoke construction are adjusted to the desired shape of the concrete structure.

* * * * *